United States Patent [19]

van Kessel

[11] Patent Number: 4,520,737

[45] Date of Patent: Jun. 4, 1985

[54] PROCESS AND REACTOR FOR THE COMBUSTION OF CARBON-CONTAINING FUEL

[75] Inventor: Matheus M. van Kessel, Amsterdam, Netherlands

[73] Assignee: Shell Oil Company, Houston, Tex.

[21] Appl. No.: 582,516

[22] Filed: Feb. 22, 1984

[30] Foreign Application Priority Data

Mar. 16, 1983 [NL] Netherlands ..... 8300950

[51] Int. Cl.[3] ..... F23J 1/02

[52] U.S. Cl. ..... 110/171; 110/165 R; 110/169; 110/170; 126/242

[58] Field of Search ..... 110/165 R, 169, 170, 110/171; 126/242; 241/46.13, 46.17; 48/76, 77

[56] References Cited

U.S. PATENT DOCUMENTS

| | | | |
|---|---|---|---|
| 946,553 | 1/1910 | Mitchell | 110/170 |
| 1,510,277 | 9/1924 | Hossack | 110/171 |
| 2,725,834 | 12/1955 | Richter-Glier | 110/171 |
| 3,883,321 | 5/1975 | Haverkamp | 110/165 R |

*Primary Examiner*—Edward G. Favors

[57] ABSTRACT

A process and apparatus for the combustion of carbon-containing fuel in a reaction zone, with the products of combustion being removed from the top of the reaction zone and the slag from the bottom of the reaction zone. The reaction zone is separated from the bottom of the reactor by a partition wall having a central opening through which the slag is removed. The central opening is maintained open by a cylindrical member that is mounted below the partition wall and moved upwardly to clear the opening.

9 Claims, 2 Drawing Figures

PROCESS AND REACTOR FOR THE COMBUSTION OF CARBON-CONTAINING FUEL

BACKGROUND OF THE INVENTION

The invention relates to a process for the complete or partial combustion of carbon-containing fuel with an oxygen containing gas in a reactor in which the gas formed is removed at the top of the reactor and slag at the bottom of the reactor. The invention also relates to a reactor for use in said process.

The combustion may be complete or partial, the object of the combustion process being in the first case the production of heat, for example, for direct or indirect power generation and in the second case, the production of synthesis gas mainly consisting of carbon monoxide and hydrogen.

By the term carbon-containing fuel is generally meant coal or another solid fuel, such as brown coal, peat, wood etc., but also liquid fuels, such as tar sand oil or shale oil can be used.

The reactor in which combustion takes place may have various shapes, such as the shape of a sphere, cone or cylinder. In order to meet the high strength requirements demanded of the reactor on the one hand and to keep the costs of manufacture within reasonable limits on the other hand, the reactor preferably has the shape of a circular cylinder.

The supply of the carbon-containing fuel and the oxygen-containing gas can take place through the bottom of the reactor. It is also possible to supply one of the reactants through the bottom of the reactor and one or more others through the side wall of the reactor. However, both the fuel and the oxygen-containing gas and a temperature moderator, if any, are preferably supplied through the side wall of the reactor. This is advantageously performed by means of at least two burners arranged symmetrically in relation to the longitudinal axis of the reactor in a lower part of the side wall.

Since carbon-containing fuel is usually of mineral origin, it invariably also contains, in addition to carbon and hydrogen, a certain quantity of inorganic, uncombustible material often referred to by the term ash which is separated during the complete or partial combustion of mineral fuel. Depending on the operating conditions under which combustion takes place, in particular the temperature and the quality of the fuel, the ash is mainly obtained in solid or liquid condition or in a combination thereof. The larger part of the liquid ash obtained, further referred to as slag, flows along the reactor wall and is generally collected in a waterbath located below the reaction zone of the reactor, where the slag cools and solidifies. Subsequently, the solidified slag can be discharged as a slurry in a relatively simple manner.

The waterbath generally forms an integral part of the reactor and is located directly below the reaction zone proper where the combustion process takes place. Because a usually substantially elevated pressure prevails in the reactor, a lock system is used to discharge the slurry of solidified slag from the reactor. In the reactor the reaction zone is normally separated from the cooling zone with the waterbath by a partition wall having a centrally located discharge opening for the slag. The slag discharge opening, often referred to by the term slagtap, should be rather narrow for various reasons. In the first place, the escape of unconverted coal through the discharge opening should be avoided as much as possible. Secondly, the slag discharge opening should be rather narrow in order to prevent that water vapor formed during the cooling of the slag in the waterbath from entering the reaction zone in excessive quantities. The penetration of the water vapor into the reaction zone proper should be limited, since the water vapor could unfavorably affect the combustion process when it enters the reaction zone in substantial quantities. Moreover, the water vapor will have a solidifying effect on the slag in the reaction zone, with the result that the slag flow to the slag discharge opening will be reduced.

Depending on the conditions in the reaction zone and the type of carbon-containing fuel used the slag will more or less easily flow to the slagtap and subsequently enter the cooling zone. If the slag flow through the slagtap is reduced it may give rise to blockage of the slagtap. If the slagtap becomes blocked the slag will accumulate in the reaction zone and the combustion process must be interrupted to clean the slagtap. Apart from the loss of production involved in stoppage of the process, there is also the aspect of poor accessibility of the reaction zone owing to the high process temperature and pressure, which will result in the cleaning of the slagtap being a complicated and time consuming matter.

SUMMARY OF THE INVENTION

The present invention aims at providing a process for the complete or partial combustion of carbon-containing fuel in which the problem of stopping the process for cleaning the slagtap can be completely or at least avoided in most cases.

The invention therefore relates to a process for the complete or partial combustion of a carbon-containing fuel with an oxygen-containing gas in a reaction zone, in which the gas formed is removed at the top of the reaction zone. The slag formed is discharged at the bottom of the reaction zone to a cooling zone that is located underneath via a slag discharge opening provided in a partition wall between the reaction zone and the cooling zone. The cooling zone contains a cooling liquid for cooling and solidifying the slag. During the combustion process the slag discharge opening is kept open by intermittently moving up and down through the slag discharge opening the upper part, which has a scraping edge, of a cylindrical device that in rest position is completely in the cooling zone below said opening.

The invention also relates to a reactor for the complete or partial combustion of a carbon-containing fuel with an oxygen-containing gas, which reactor comprises a reaction zone and a cooling zone that is located underneath. The cooling zone contains a cooling liquid during operation and the reactor is provided with a gas outlet at the top of the reaction zone and a slag discharge at the bottom of the cooling zone. The reaction zone is separated from the cooling zone by a partition wall provided with a slag discharge opening and having a cylindrical device mounted coaxially with the slag discharge opening. The device is provided with a scraping edge near the top end, and means are present for moving the cylindrical device up and down through the slag discharge opening.

By regularly moving the above-mentioned cylindrical device, which is provided with a scraping edge, up and down through the slag discharge opening, the latter can simply be cleaned of slag deposits without stopping the combustion process. Since the cylindrical device is in rest position in the cooling zone and is preferably submerged in the cooling liquid where a relatively low temperature prevails, there is no risk of the device being damaged by overheating. Further, the device is completely outside the slag discharge opening in rest position, the cylindrical device does not impede the passage of the slag through the slag discharge opening.

In the cleaning process use is made of a cylindrical device the side wall of which is provided with a helical scraping edge. By rotating a cleaning device of this design at such a speed during the movement through the slag discharge opening, that a downward force is exerted on the slag to ensure that the slag discharge opening is cleaned and the slag is forcefully removed from the reaction zone.

BRIEF DESCRIPTION OF THE DRAWINGS

The invention will now be further discussed with reference to the appertaining figures, in which.

DESCRIPTION OF THE PREFERRED EMBODIMENT

Figure 1:
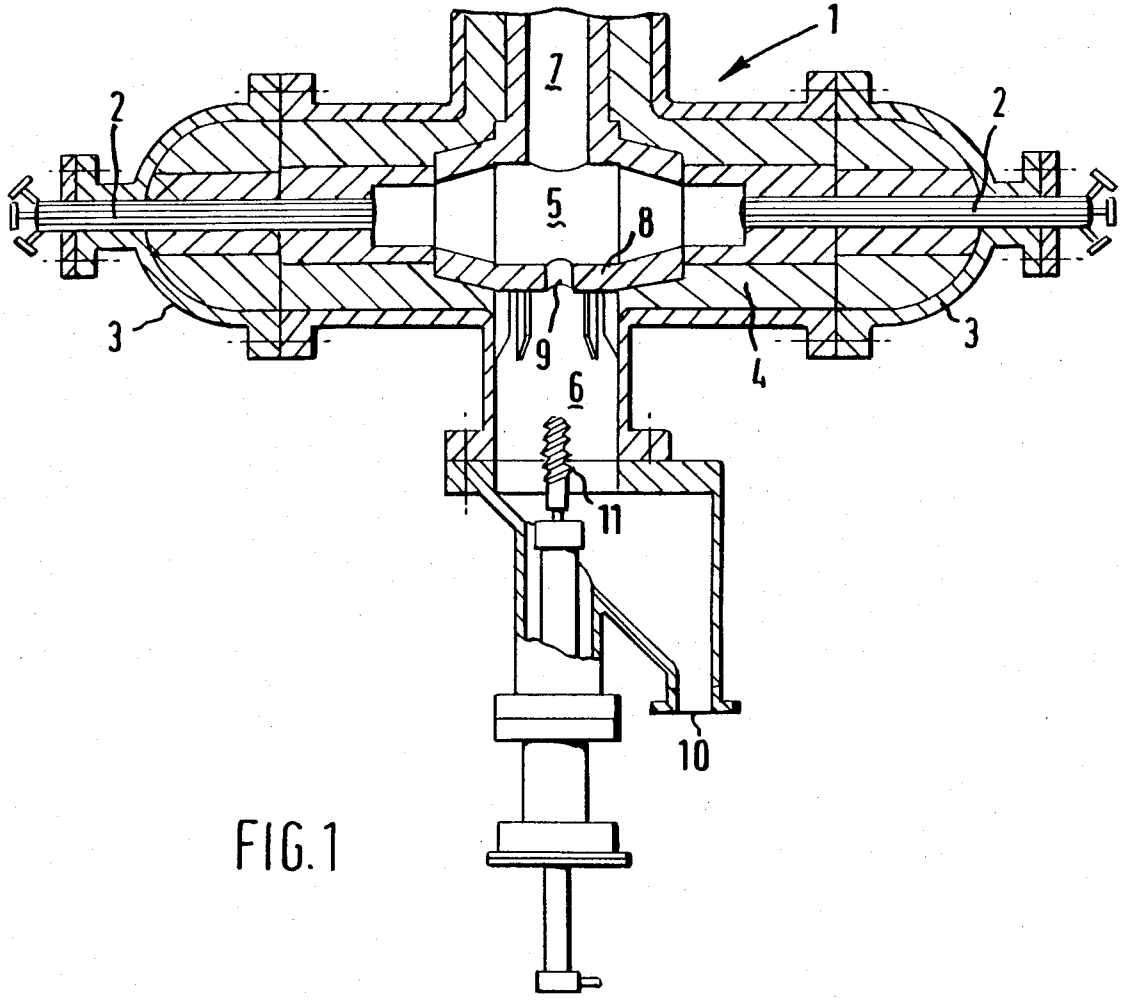
FIG. 1 diagrammatically shows a longitudinal section of a combustion reactor for carrying out the invention.

The reactor, designated by reference numeral 1 in FIG. 1, can for example, be used for the preparation of synthesis gas by the partial combustion of a carbon-containing fuel, such as finely ground coal.

The reactor 1 is provided with two opposite burners 2 located in the side wall 3 of the reactor. In order to protect the side wall 3 against the high process temperature, its inside is provided with a heat resistant insulation 4. As shown in FIG. 1 the insulation 4 is preferably built up of several layers. The interior of the reactor 1 is subdivided into a reaction zone 5, a cooling zone 6 and a gas outlet 7. The reaction zone 5 is separated from the cooling zone 6 by a partition wall 8 in which a slag discharge opening 9 is preferably centrally made. The upper part of the gas outlet 7 is provided with means (not shown) for cooling the gas before it leaves the reactor 1. The cooling zone 6 is provided with a discharge opening 10 for the discharge of solidified and cooled slag. Said discharge opening 10 is connected to a lock system (not shown) for reducing the pressure. In the cooling zone 6 is a cylindrical device 11 for keeping the slag discharge opening 9 clean. As shown in the figures said device is in line with the slag discharge opening 9.

Figure 2:
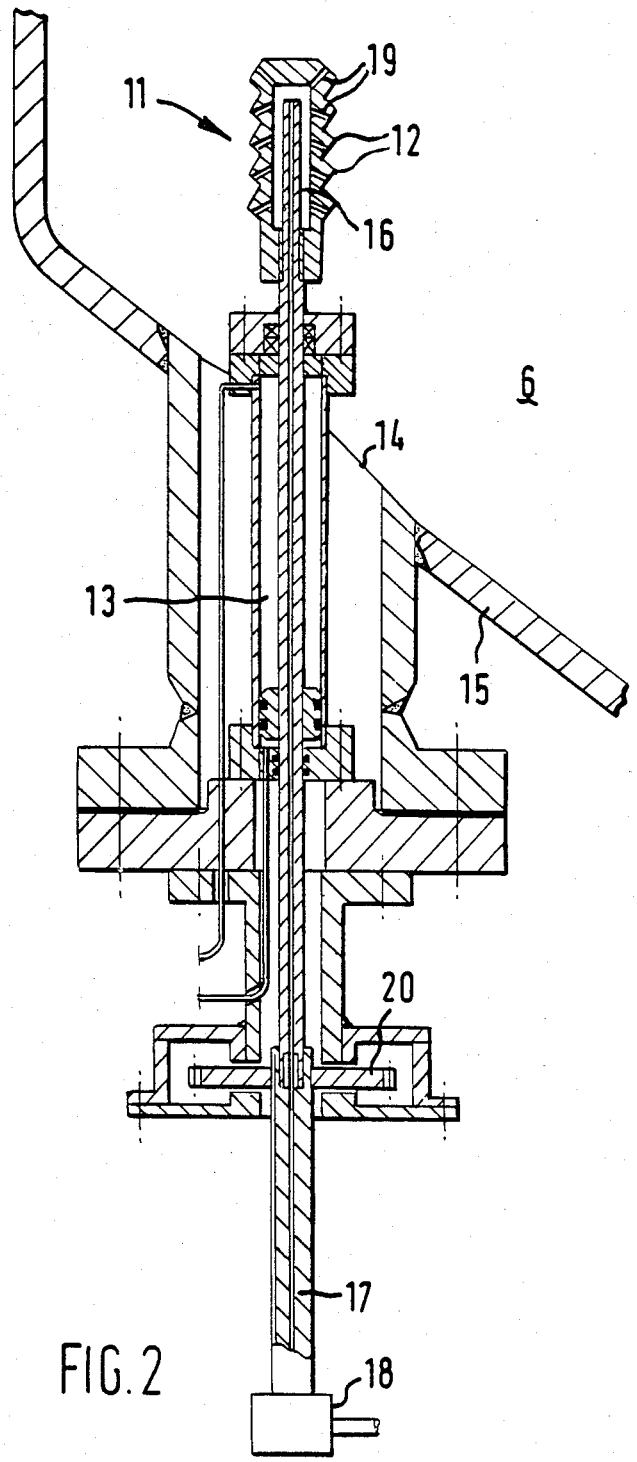
FIG. 2 shows a detailed longitudinal section of the cleaning device used in said reactor, on a larger scale than that of FIG. 1.

For the following detailed description of the cleaning device 11 reference is made to FIG. 2. The outside of the cylindrical cleaning device 11, the diameter of which is in accordance with the size of the slag discharge opening 9, is provided with a helical scraping edge of the single or multiple thread type. The cleaning device shown in FIG. 2 is provided with a double helical scraping edge 12. The device 11 is connected to a hydraulic cylinder 13 for moving the device up and down. Said hydraulic cylinder 13 is fitted through an opening 14 in a wall 15 defining the cooling zone 6. The stroke the piston of the hydraulic cylinder 13 is can make is such that in the upper position the cleaning device 11 projects from the slag discharge opening 9. In order to enable the device 11 to be cooled internally its design is hollow, the hollow space 16 being connected to a line 17 that is in turn connected to a rotatable device 18 for supplying cooling liquid to the device 11. The discharge of the cooling liquid from the space 16 can be effected by laterally directed ports 19 that are so arranged that during operation the cooling liquid also ensures that the scraping edge 12 is cooled. The cleaning device 11 is further coupled to a driving wheel 20 for rotating said device. The driving wheel 20 is in turn driven by a driving mechanism (not shown).

The operation of the above reactor for example for the preparation of synthesis gas is as follows. Powdery fuel, insufficient oxygen and a moderator gas, if any, are supplied to the reaction zone 5 of the reactor 1 via the burners 2. The partial combustion yields synthesis gas as a valuable product and slag as a by-product. The gas formed leaves the reaction zone 5 via the gas outlet 7. The temperature in the reaction zone must be kept at such a level that the slag formed remains liquid and can flow along the reactor wall to the slag discharge opening 9 in the partition wall 8. Via the slag discharge opening 9 the slag enters the cooling zone 6 that contains a waterbath. Subsequently, the slag drops in the waterbath, where it solidifies and is cooled further. The slag is regularly discharged as a slurry via the discharge opening 10.

Since the temperature in the cooling zone is about 100° C. , whereas the solidification temperature of the slag is much higher, it will often occur that the slag starts solidifying near the slag discharge opening and deposits on the partition wall 8, so that the discharge opening is clocked. The slag discharge opening can also be blocked by incidental instability of the process resulting in unconverted coal, for example, enters the opening. Continuous operation can now be ensured by regularly cleaning the slag discharge opening 9 during operation. To this end the cylindrical device 11 is moved upwards by means of the hydraulic piston 13 and brought into the slag discharge opening 9 while said element is simultaneously rotated by the driving wheel 20. The scraping edge 12 ensures that deposits formed by highly viscous slag and/or partly converted or unconverted coal are forced down. Cooling liquid supplied to the hollow space 16 in the device through the line 17 can be ejected through the ports 19 to cool the cylindrical device 11. The cooling liquid also cools scraping edge 12 to ensure that deposits in the discharge opening 9 can be easily removed and do not deposit on the scraping edge. At least during the upward movement through the slag discharge opening the device is rotated at such a speed that a downward force is exerted on the deposits, which force ensures that the deposits are forced through the discharge opening to the cooling zone 6. It will be obvious that said desired rotational speed is related to the axial displacement of the cylindrical device 11 and to the pitch of the helical scraping edge 12.

The frequency in which the slag discharge opening should be cleaned depends on the degree of slag deposition which is in turn dependent on the type of carbon-containing fuel and the operating conditions. In rest position the cylindrical device is preferably immersed in the waterbath in the cooling zone 6. In this position it is not necessary to cool the device internally.

In the embodiment shown the hydraulic cylinder 13 is located in a boss that is fitted to the bottom of the reactor, the pressure in said boss being the reactor pressure. However, the driving mechanism for the rotating movement and the cooling liquid supply to device 11, are located outside said boss. It will be obvious that the latter devices can also be accommodated in the reactor or a boss fitted thereto, although the embodiment shown is preferred in view of the better accessibility.

Instead of a laterally located slag discharge 10, slag removal can also be effected centrally via the boss in which the hydraulic cylinder 13 is located.

The helical scraping edge shown is in particular suitable for very persistent deposition of viscous slag and/or partly converted or unconverted coal.

Finally, it should be noted that the cylindrical device can be coupled to a known controller for automatically intermittently moving the device in the slag discharge opening. When the deposition of slag is less serious use may also be made of simpler scraping edges, such as a single thread scraping edge at the top of the device, in which the rotating movement of the cleaning device during operation can be dispensed with.

What is claimed is:

1. A process for the combustion of a carbon-containing fuel with an oxygen containing gas comprising:

reacting the fuel and gas in a reaction zone;

removing the products of combustion from the top of the reaction zone;

discharging the slag by gravity from the reaction zone to a cooling zone through an opening in a partition separating the reaction and cooling zones;

cooling and solidifying the slag in the cooling zone; and maintaining the opening in the partition clear by periodically vertically moving a cylindrical member upwardly through said opening and then retracting said cylindrical member downwardly from said opening.

2. The process of claim 1 wherein said cylindrical member is cooled.

3. The process of claim 1 or 2, wherein said cylindrical member is immersed in the cooling fluid when retracted from said opening.

4. A reactor for the combustion of carbon-containing fuel with an oxygen-containing gas comprising:

a reactor vessel, said vessel having a reaction zone separated from a cooling zone in the bottom by a partition wall, and a gas outlet at the top for the products of the combustion;

said partition wall having an opening for discharging slag from said reaction zone to said cooling zone;

a cylindrical member mounted in said cooling zone below the opening in said partition wall for movement up and down through the opening, said cylindrical member having a scraping edge disposed adjacent its top end; and means for moving said cylindrical member up and down to intermittently clean said opening.

5. The reactor of claim 4 wherein said scraping edge comprises a helical edge formed on the outer surface of said cylindrical member.

6. The reactor of claim 5 and in addition means coupled to said cylindrical member for rotating the cylindrical member.

7. The reactor of claim 4, 5 or 6 wherein said cylindrical member is hollow and provided with supply and discharge openings for circulating a cooling fluid through the cylindrical member.

8. The reactor of claim 8 wherein said cylindrical device has at least one discharge opening for supplying cooling fluid to the outer surface of the cylindrical member.

9. The reactor of claim 5 wherein the means for intermittently moving said cylindrical member up and down comprises a fluid operated means.

* * * * *